US006645096B1

(12) United States Patent
Nally et al.

(10) Patent No.: US 6,645,096 B1
(45) Date of Patent: Nov. 11, 2003

(54) FOLDABLE TABLE TENNIS TABLE

(75) Inventors: Michael J. Nally, Ridgewood, NJ (US); David Rossi, Newton, NJ (US)

(73) Assignee: Sportcraft, LTD, Mt. Olive, NJ (US)

( * ) Notice: Subject to any disclaimer, the term of this patent is extended or adjusted under 35 U.S.C. 154(b) by 0 days.

(21) Appl. No.: 10/279,699

(22) Filed: Oct. 24, 2002

(51) Int. Cl.[7] ..... A63B 67/04
(52) U.S. Cl. ..... 473/496
(58) Field of Search ..... 108/115, 119, 108/120, 127, 129; 473/496

(56) References Cited

U.S. PATENT DOCUMENTS

| | | | | |
|---|---|---|---|---|
| 1,757,260 | A | 5/1930 | Silverman | |
| 1,995,543 | A | 3/1935 | Kaser | |
| 2,023,844 | A | 12/1935 | Kleinman | |
| 2,569,007 | A | 9/1951 | Klyce | |
| 2,901,304 | A | 8/1959 | Fihe | |
| 3,190,649 | A | 6/1965 | Heisler | |
| 3,229,790 | A | 1/1966 | Shayne | |
| 3,267,885 | A | 8/1966 | Shore | |
| 3,318,269 | A | 5/1967 | Kinn | |
| 3,342,149 | A | 9/1967 | Kruissink | |
| 3,489,410 | A | 1/1970 | Stillman et al. | |
| 3,503,525 | A | 3/1970 | Loebner | |
| 3,525,492 | A | 8/1970 | Friedman et al. | |
| 3,661,100 | A | 5/1972 | Tennant | |
| 3,717,343 | A | 2/1973 | Hartford | |
| 3,823,938 | A | 7/1974 | Unno | |
| 3,827,376 | A | 8/1974 | Solomon | |
| 3,830,495 | A | 8/1974 | Hill | |
| 3,858,877 | A | 1/1975 | Lundstrom | |
| 4,016,819 | A | 4/1977 | Cowling | |
| 4,067,266 | A | 1/1978 | Lafargue | |
| 4,142,718 | A | 3/1979 | Luckey | |
| 4,327,650 | A | 5/1982 | Bue | |
| 4,469,029 | A | 9/1984 | Ramond | |
| 4,478,415 | A | 10/1984 | Shaffer et al. | |
| 4,489,661 | A | 12/1984 | Fitzgerald | |
| 4,762,321 | A | 8/1988 | Chang | |
| 4,911,085 | A | 3/1990 | Pencoske | |
| D308,922 | S | 7/1990 | Ng et al. | |
| 5,613,450 | A | 3/1997 | Wagner et al. | |
| D378,635 | S | 4/1997 | Studer et al. | |
| 5,816,957 | A | 10/1998 | Dadbeh | |
| 2002/0119844 | A1 * | 8/2002 | Dadbeh | 473/496 |

FOREIGN PATENT DOCUMENTS

| | | | |
|---|---|---|---|
| GB | 2048660 | * 12/1980 | A47B/3/00 |

* cited by examiner

*Primary Examiner*—Raleigh W. Chiu
(74) *Attorney, Agent, or Firm*—Jay G. Taylor; John F. Prescott; Ice Miller

(57) ABSTRACT

A collapsible table tennis table in accordance with the present invention includes a first and second table portions pivotably attached to a rigid central support unit. The central support unit comprises two unitary curvilinear members each formed of a single piece of appropriate material such as steel tubing. The central support unit is easily assembleable using appropriately formed connecting members which are attached using wing bolts so that tools are not required for assembly. Exterior legs are pivotably attached adjacent to the exterior edges of the table members. The table portions are also pivotably attached to the respective curvilinear members so that the table portions can be pivoted from an essentially horizontal position to an essentially vertical position for storage and movement. The central support unit typically has wheels to facilitate the movement of the assembled table. The foldable table tennis table in accordance with the present invention has the advantage of being able to be packaged in a minimal profile package for shipment to the customer, and can be easily assembled by the customer by hand without the need of any tools.

11 Claims, 3 Drawing Sheets

FOLDABLE TABLE TENNIS TABLE

BACKGROUND OF THE INVENTION

1. Field of the Invention

The present invention relates to a foldable table tennis table which can be folded into a compact unit for easy movement and storage and which can be shipped from the factory in a compact form in packaging with a minimum profile. The present invention can also be easily assembled by the customer by hand without the need for any tools.

2. Description of the Prior Art

Foldable table tennis tables are well known in the art. It has long been recognized that it is desirable to have a table tennis table which is foldable into a more compact, easily moved and easily stored configuration. However, prior art foldable table tennis tables have a number of deficiencies which have detracted from their desirability. Many of the prior art foldable table tennis tables have complex structure which is expensive to fabricate and difficult to assemble, particularly by a retail customer who may not have the necessary tools for proper assembly. Such prior art tables typically must be shipped in large, bulky containers which take up substantial space in storage and in transit thereby increasing the shipping costs. For example, some of the prior art foldable table tennis tables such as those disclosed in U.S. Pat. No. 3,342,149-Kruissink, U.S. Pat. No. 3,318,269-Kinn and U.S. Pat. No. 2,901,304-Fihe disclose foldable table tennis tables having a relatively complex welded wheel support unit which is both expensive to fabricate and difficult to package and ship to a customer. Additionally, prior art foldable table tennis tables of the type disclosed in U.S. Pat. No. 5,816,957-Dadbeh have a relatively complex structure with a wide wheel base which makes it more expensive to manufacture and more difficult to store in confined spaces.

Accordingly, it would be desirable to provide a collapsible table tennis table which is relatively inexpensive to fabricate, easily packaged and shipped in a compact, minimally sized package, easily assembled by the customer by hand without the need of any tools and is foldable into a relatively compact arrangement which is easily stored in a minimal amount of space.

SUMMARY OF THE PRESENT INVENTION

The present invention provides a foldable table tennis table which is capable of being fabricated without the necessity for welding or other expensive labor intensive operations, which can be boxed and shipped to the customer in a compact, minimal profile package and which can be assembled easily and quickly by the customer by hand without the need for tools. Such a table in accordance with the present invention is typically partially assembled at the factory so that the various members requiring tools for assembly are attached at the factory leaving only minimal assembly without tools by the customer. Due to the unique design, the preassembled parts are folded into a relatively flat configuration and the remaining parts are capable of being shipped in a similar flat configuration so that very compact, minimal profile packaging is required for shipment.

A foldable table tennis table in accordance with the present invention comprises first and second unitary curvilinear member formed of a single piece of material such that each has a first lower portion and a first and second upwardly extending supporting portions. The supporting portions have first and second ends with the first ends being integrally joined to the lower portion. The first and second curvilinear members are joined together by first and second connecting members connected between the first and second curvilinear members to form a rigid central support unit. An additional connecting member may be connected between the respective lower portions of the first and second curvilinear members. First and second table portions each having an upper and lower surface, a center edge and an outer edge and two opposing side edges are respectively pivotably connected to the central support unit at the second ends of the supporting portions of the first and second curvilinear members adjacent the center edge of the first and second table portions.

Thus, the first and second table portions can be pivoted from an essentially horizontal playing position where the center edges of the table portions are in close proximity to one another to an essentially vertical position for movement and storage. The present invention is designed so that the outer edges of the first and second table portions are essentially parallel and slightly closer together than the inner edges of the first and second table portions when the table portions are pivoted to their essentially vertical position so that it is less likely that the table portions will accidentally pivot back to a horizontal position during movement and storage.

The foldable table tennis table in accordance with the present invention also has at least one first and at least one second exterior leg member attached to the lower surface of the first and second table portions respectively adjacent the outer edge of the first and second table portions. The first and second exterior leg members are typically pivotably attached to the respective first and second table portions so that the exterior leg members can be folded against the lower surface of the first and second table portions respectively or pivoted until they are essentially perpendicular to the table portion. The first and second exterior leg members, when pivoted perpendicular to the table portions, contact the floor to support the first and second table portions in an essentially horizontal position. A connecting member may be pivotably connected between the first curvilinear member and the first exterior leg member, and another connection member pivotably connected between the second curvilinear member and the second exterior leg member in such a manner such as to cause the first and second leg members to be automatically pivoted against the lower surface of the respective table portions as the table portions are pivoted from the essentially horizontal position to the essentially vertical position.

The first exterior leg member may comprise first and second extensions each pivotably attached at one end to the first table portion. A detachable unitary curvilinear support member can be detachably connected to the other ends of the first and second extensions to provide a leg member that will extend and contact the floor and support the table portions in an essentially horizontal position. The unitary curvilinear support member may be detached to facilitate shipping of the table in a compact package with a minimal profile. Similarly, the second exterior leg member may also comprise third and fourth extensions pivotably attached to the second table portion and a comparable detachable second unitary curvilinear support member.

Typically, wheels are attached to the first and second lower portions of the first and second unitary curvilinear members to allow the rigid central support unit and attached first and second table portions to be easily rolled from place to place when the table portions are in the essentially vertical storage position. To facilitate assembly, the first and second curvilinear members have apertures formed there through that align with apertures in the first and second connecting members. During assembly, the apertures are aligned and removable fasteners that are capable of being tightened and loosened by hand without the necessity for tools are inserted through the apertures and tightened by hand to assemble the rigid support unit.

These and other objects, advantages and features shall hereafter appear in the following detailed description of the preferred embodiment which are provided for the purposes of illustration, but not, for limitations of the scope of the present invention.

DETAILED DESCRIPTION OF THE PREFERRED EMBODIMENTS

Figure 1:
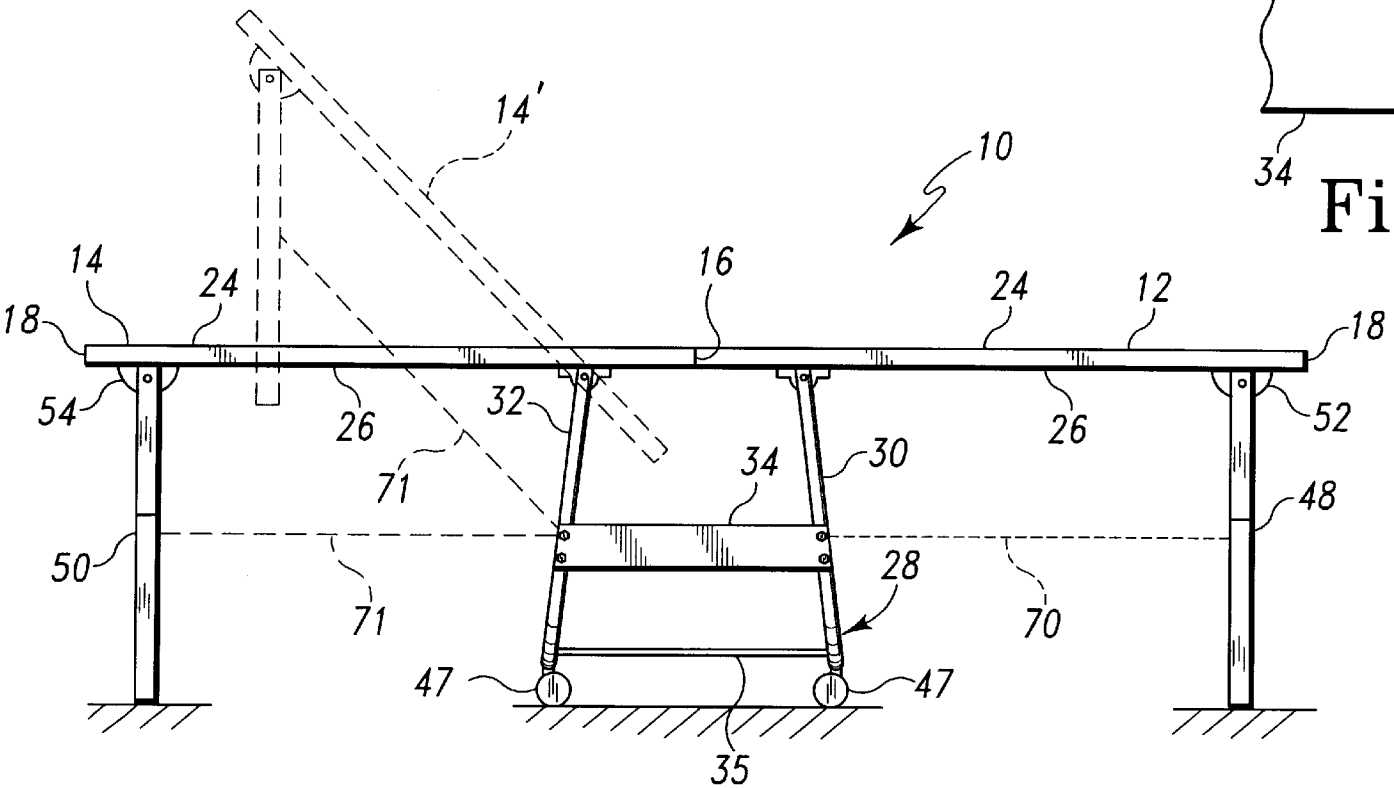
FIG. 1 is a side view of a foldable table of the present invention oriented in the essentially horizontal playing position with dotted lines showing one half of the table being pivoted toward the essentially vertical position.
Figure 2:
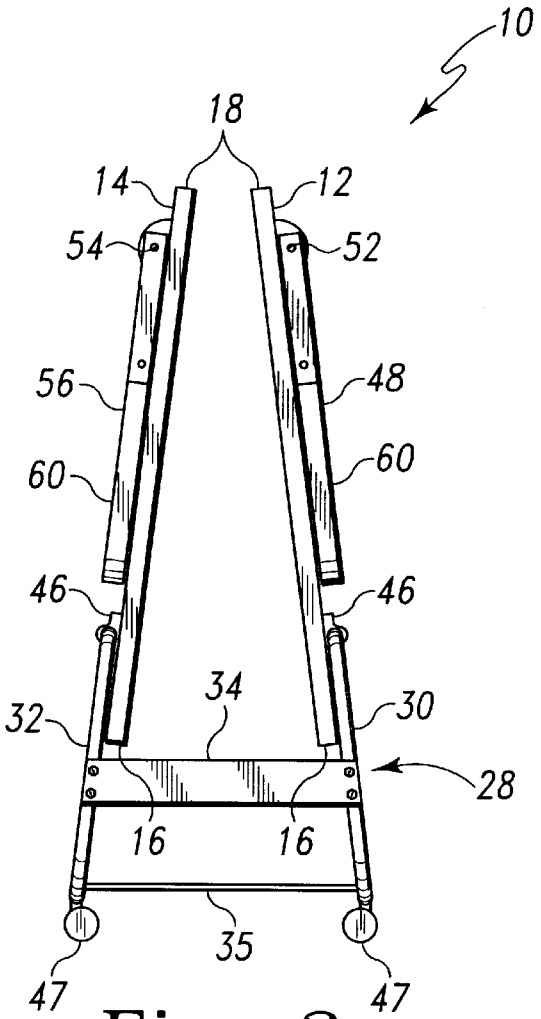
FIG. 2 is a side view of a first embodiment the present invention showing the respective table portions being pivoted to their essentially vertical position.
Figure 3:
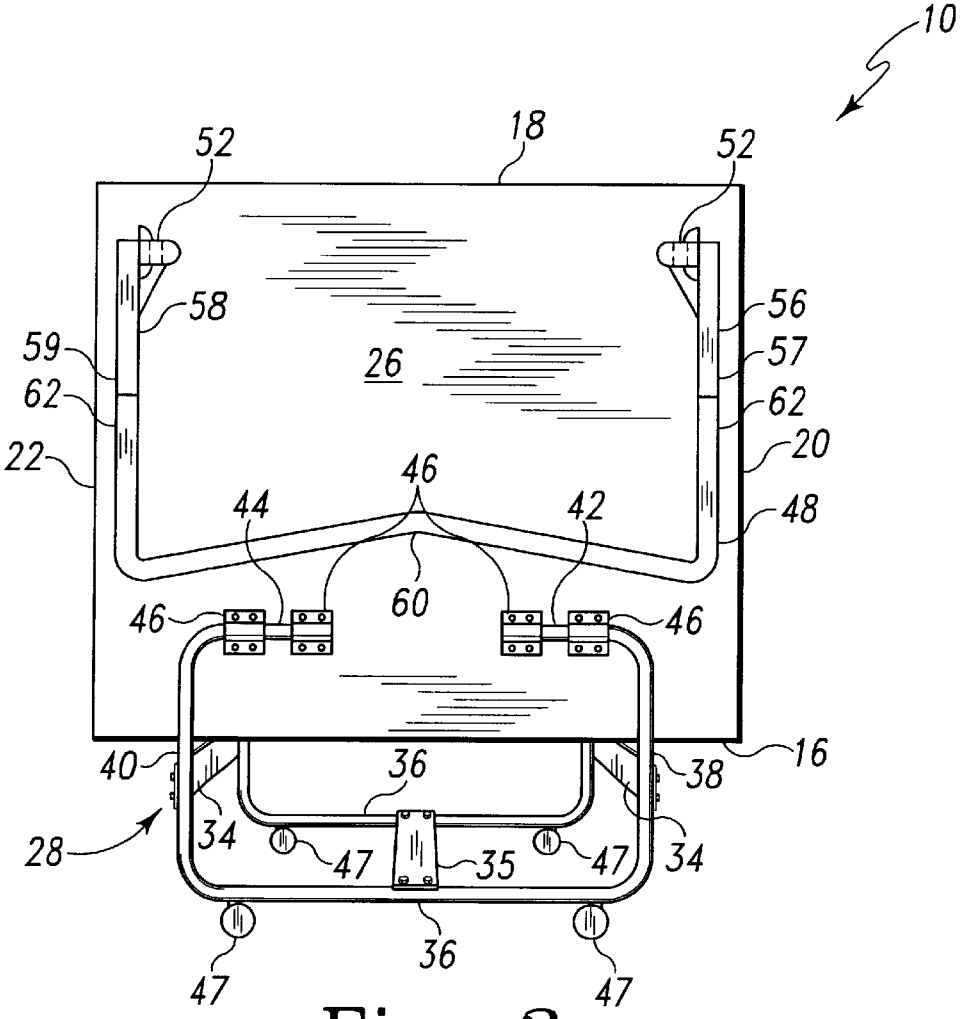
FIG. 3 is an end view of a first embodiment of the present invention showing the table portion in an essentially vertical position.

With reference to FIGS. 1, 2 and 3, a foldable table 10 constructed in accordance with the teachings of the present invention is illustrated. Table 10 comprises a first table portion 12 and a second table portion 14 which are essentially rectangular in shape. First and second table portions 12 and 14 each have a center edge 16 and an outer edge 18 and side edges 20 and 22. First and second table portions also each have an essentially flat upper playing surface 24 and an essentially flat lower surface 26.

An essentially rigid central support unit 28 is provided comprising first curvilinear member 30 and second curvilinear member 32 joined together by connecting members 34 and 35 to form an essentially rigid central support unit 28.

First and second unitary curvilinear members 30 and 32 are formed from a singular unitary piece of material and typically of tubular steel or other metals. First and second curvilinear members 30 and 32 are both formed to have a lower portion 36 which is essentially straight and normally parallel to the floor when assembled. Upwardly extending first and second supporting portions 38 and 40 are integrally formed at the ends of lower portion 36 by bending the tubular member so that supporting portions 38 and 40 are essentially perpendicular to the lower portion 36.

The first and second curvilinear members 30 and 32 also comprise upper extension 42 and 44 which are similarly formed by bending the upper ends of the curvilinear members until they are essentially parallel with lower portions 36. Thus, each of the first and second curvilinear members 30 and 32 comprise a single unbroken piece of material which is formed into an essentially U-shaped structure. This structure provides advantages over the prior art as it is easily and inexpensively fabricated and is very strong.

Upper extensions 42 and 44 are each attached to the lower surface 26 of first and second table portions 12 and 14 by bracket members 46 which allow first and second table portions 12 and 14 to be easily pivoted around the upper extensions of the first and second curvilinear members from the essentially horizontal position shown in FIG. 1 to the essentially vertical position shown in FIGS. 2 and 3 and back again.

Wheels 47 may be appropriately affixed to the lower portions 36 of first and second curvilinear members 30 and 32 to facilitate movement of the table when the table portions are in their essentially vertical position. Wheels 47 may typically comprise pivotably mounted wheel units which will allow the wheel to rotate about a vertical axis to allow movement in any direction.

Also attached to the lower surface of first and second table portions respectively are first exterior leg member 48 and second exterior leg member 50. First and second exterior leg members 48 and 50 are pivotably connected by bracket members 52 and 54 so that the exterior leg members can be pivoted from a position essentially perpendicular to the table portions 12 and 14 illustrated in FIG. 1 to the position illustrated in FIGS. 2 and 3 wherein the exterior leg members are folded against the lower surface of the respective table portions 12 and 14.

To facilitate shipping and storage, first and second exterior leg members 48 and 50 may be formed in multiple pieces. As illustrated in FIGS. 2 and 3, exterior leg member 48 comprises a first and second leg extension 56 and 58 each pivotably connected to the table portion by bracket member 52. The first exterior leg member also comprises a unitary curvilinear support member 60 which is formed of a single unitary piece of material such as tubular metal material into an essentially U-shaped structure. The ends 62 of curvilinear support member 60 are formed to mate with the free ends 57 and 59 of extensions 56 and 58 in a detachable manner so that curvilinear support member 60 can be disengaged from extensions 56 and 58. For example, ends 62 can be formed with a taper so that they can be inserted into hollow ends of extensions 56 and 58 and a suitable retaining mechanism, such as a detent, may be used to hold the support member 60 onto the extensions 56 and 58. Second exterior leg member 50 may be formed in the same manner with comparable extensions and support member.

Figure 6:
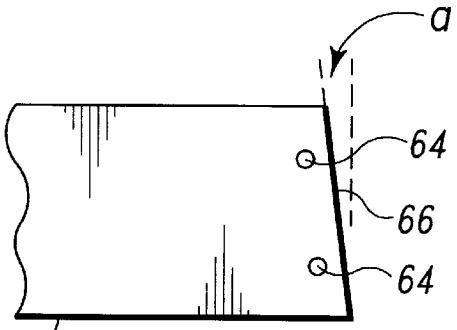
FIG. 6 is a side, partially fragmented view of the end of a side connecting member of the present invention.

With reference to FIG. 6, side connecting members 34 may be formed with apertures 64 formed there through dimensioned to align with comparable apertures (not shown) in supporting portions 38 and 40 of first and second curvilinear members 30 and 32. Similarly bottom connecting member 35 has apertures formed there through (not shown) which are dimensioned to align with comparable apertures (not shown) in lower portions 36 of the first and second curvilinear members. Hand operable fasteners (not shown), typically bolts (with hand operable wing nuts), are seated through the apertures and tightened by hand to attach the connecting members 34 and 35 to the curvilinear members 30 and 32 to form the rigid central support unit 28.

Also, the ends of connecting members 34 are tapered slightly so that the outer surface 66 is angled slightly as indicated by the angle "a" as indicated in FIG. 6 so that when the first and second curvilinear members are joined together by the side connecting members 34 the curvilinear members are angled toward one another slightly as illustrated in FIGS. 1 and 2 so that when the first and second table portions 12 and 14 are pivoted to their essentially vertical position shown in FIG. 2, the outer edges 18 of the table portions are essentially parallel and slightly closer together than the center edges 16 of the respective table portions. Because of that slight angular tilt, the table portions 12 and 14 will remain in an essentially upright position with the lower edges 16 pressed against the supporting portions 38 and 40 of the respective first and second curvilinear members. This arrangement aids in preventing the table portions from accidentally pivoting and falling back to a horizontal position during movement and storage.

With reference to FIG. 1, an alternative configuration is shown in dotted lines. A connecting member 70 is pivotably connected between first curvilinear member 30 and first exterior leg member 48 and another connecting member 71 is pivotably connected between second curvilinear member 32 and second exterior leg member 50. As illustrated by the dotted lines in FIG. 1, as the table portion 14 is pivoted upwardly to the position identified by 14' (as shown in dotted lines), connecting member 71 causes exterior leg member 50 to pivot towards table member 14' (as shown in dotted lines) and when the table portions are as shown in FIG. 2, the connecting members 70 will cause the exterior legs to fold until they are flat against the lower surface of the respective table portions 12 and 14. Thus, the connecting members 70 and 71 may optionally be added to facilitate folding of table 10.

Figure 4:
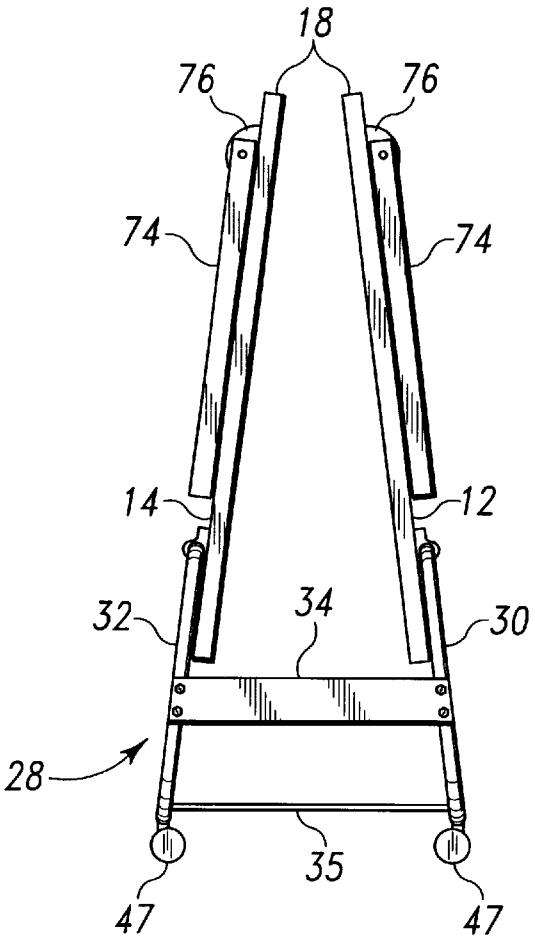
FIG. 4 is a side view of an alternative embodiment of the present invention.
Figure 5:
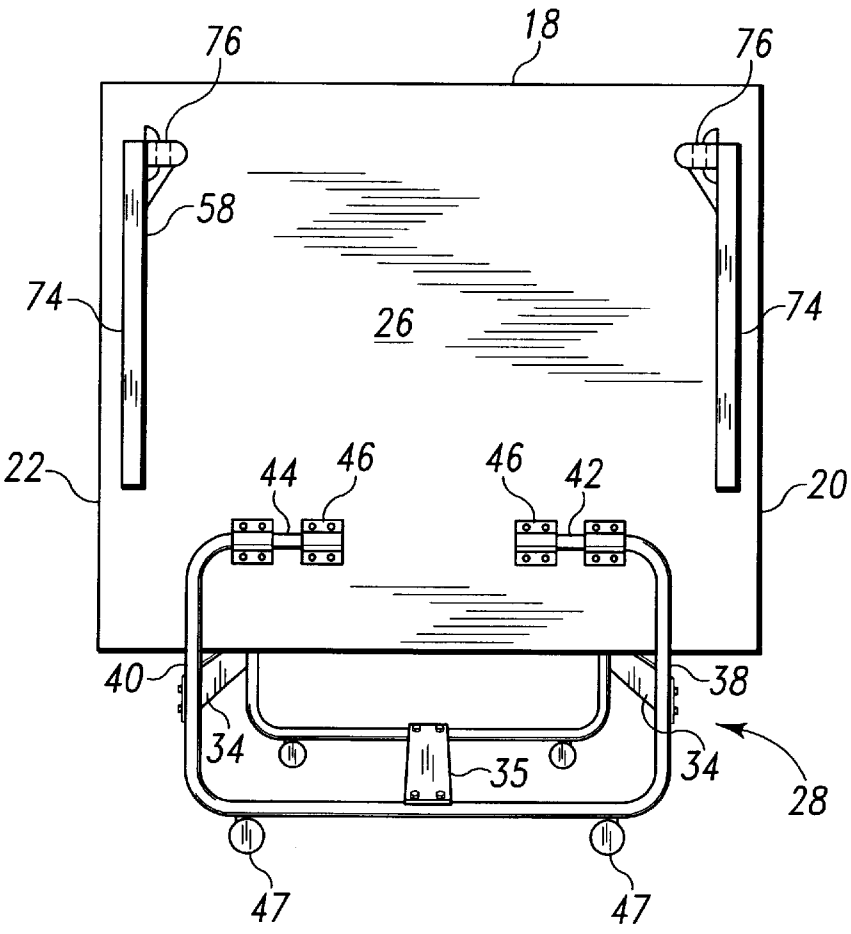
FIG. 5 is a end view of the embodiment illustrated in FIG. 4.

With reference to FIGS. 4 and 5, an alternative embodiment of the exterior leg members is illustrated. In FIGS. 4 and 5, all of the various common elements are numbered the same as FIGS. 1, 2 and 3. The exception is the exterior legs 74, each of which comprise a single elongated member pivoted at one end by bracket 76 and capable of being pivoted to a position essentially 90 degrees to the bottom surface of table portions 12 and 14 respectively to support the table portions 12 and 14 in an essentially horizontal position. Additionally, connecting members of the type illustrated in FIG. 1 and identified by the numerals 70 and 71 may be connected between the respective leg members 74 and the respective curvilinear members 38 and 40 to allow the leg members 74 to be automatically pivoted when the table portions are elevated to their essentially vertical position.

The design of the present invention is both economical to fabricate, shippable in a very confined, minimal profile package and easy to assemble. With reference to FIGS. 1, 2 and 3, curvilinear members 30 and 32 are easily and inexpensively formed by a bending operation using steel tubing material. Similarly, exterior leg member 48 and 50 can be easily formed by cutting first and second extensions 56 and 58 at the appropriate length from tubing material and forming the curvilinear support member 60 by bending tubular material into the U-shaped form shown in FIG. 3. An appropriate taper can be added to ends 62 by a rolling operation. Factory assembly and packaging of the foldable table tennis table in accordance with the present invention is relatively simple due to the simplicity of construction and minimal number of parts. The first and second curvilinear members 30 and 32 are respectively attached to the first and second table portions 12 and 14 using bracket members 46 which are appropriately attached at the factory screws or other fasteners to the lower surface of the respective table portions adjacent the center edge as illustrated in FIGS. 1, 2, 3, 4 and 5. In the FIGS. 1, 2 and 3 embodiment, first and second extensions 56 and 58 are attached by screwing pivotably attached bracket members 52 and 54 to the lower surface of the respective table portions using screws or other appropriate fasteners at the factory. In the FIGS. 4 and 5 embodiment, leg members 74 are similarly attached by screwing pivotably attached bracket members 76 to the lower surface of the table portions at the factory.

For packaging purposes, the curvilinear members 30 and 32 are respectively pivoted until they are against the lower surface of the respective table portions 12 and 14 and totally within the parameters of the edges of table portions 12 and 14. In the FIGS. 1–3 embodiment, extensions 56 and 58 are pivoted until they contact the lower surface of the respective table portions and the curvilinear support member 60 is detached and placed against the lower surface of the table portion between the center edge and bracket members 46 so that the curvilinear support members are totally within the perimeter of the edges of the respective table portions. The connecting members 34 and 35 are placed flat against the lower surface of the table portion within the perimeter of the curvilinear member and the upper playing surfaces of the two table portions 12 and 14 are placed flat against one another. In this manner, the packaging for the entire table need only to be big enough to encompass the perimeter of the two table portions 12 and 14 placed one on top of the other and wide enough to encompass the two table portions and the attached curvilinear members and extensions when in a flat folded position.

Similarly, with the FIGS. 4 and 5 embodiment, leg members 74 need only be pivoted flat against the surface of the respective table portion and the curvilinear members pivoted upwardly flat against the lower surface 26 of the table portion and the respective connecting members 34 and 35 placed flat against the lower surface 26 within the perimeter of one of the curvilinear members along with the fasteners necessary to attach the connecting members. Thus, either embodiment of the table 10 can be packaged in a very compact shipping container.

Assembly of the foldable table tennis table in accordance with the present invention upon delivery to a customer is extremely easy. The two table portions are removed from the box and placed on their sides parallel to one another. The curvilinear members 30 and 32 are pivoted until the apertures in the connecting members 34 and 35 can be aligned with the corresponding apertures drilled in the curvilinear members 30 and 32. The fasteners are inserted through the apertures. The fasteners (not shown) typically comprise bolts with wing nuts which can be tightened by hand without the need of tools to assemble the central support unit 28. However, any type of hand operable fastener will suffice. Wheels 47, are typically of the pivot type that have a stem that can be inserted into pre-drilled apertures in the lower portions 36. In the FIGS. 1–3 embodiment, the curvilinear support member 60 is attached to the free ends of extensions 56 and 58 using a detent or other suitable locking mechanism. The table is then ready to be pivoted to a playing position as illustrated in FIG. 1 with the two table portions 12 and 14 in an essentially horizontal position.

For the FIGS. 4 and 5 embodiment, the central support unit 28 is assembled in the same manner as the FIGS. 1–3 embodiment and no further assembly is required for leg members 74 other than to pivot them to a position perpendicular to the lower surface so that they will support the table in an essentially horizontal position.

If the table includes the automatic leg folding arrangement illustrated by the dotted lines 70 and 71 in FIG. 1, additional assembly will be required to connect the connecting members 70 and 71 between the curvilinear members and the exterior legs. This assembly can also be accomplished by pre-formed appropriate apertures in the respective members and using wing nuts for the attachment of members 70 and 71 so that no tools are required.

It should also be recognized that while the embodiment illustrated in FIGS. 1–6 show a central support unit with lower portions 36 of the curvilinear members 30 and 32 being essentially parallel to the inner edges 16 of the table portions 12 and 14, and the connecting members 34 and 35, perpendicular to the inner edges 16 of the table portions 12 and 14, the central support unit could alternatively easily be fabricated so that could be rotated 90 degrees, and still achieve all of the advantages and features of the present invention. For example, upper extensions 42 and 44 could be formed to be essentially perpendicular to both the lower portion 36 and the supporting portions 38 and 40. Also the length of the connecting members 34 and 35 and the length of the lower portions 36 could be adjusted appropriately. The supporting unit could then be rotated 90 degrees and the table portions attached so that one table portion 12 is pivotably attached on one end of the curvilinear members and the other table 14 is attached to the other end of the curvilinear members. To facilitate safety, in this alternative construction, the upper ends of supporting portions 38 and 40 could be tilted slightly toward one another during the bending operation so that the table portions tilt toward one another slightly when raised to the essentially vertical position.

While the present invention has been described in conjunction with the above-described embodiments hereof, it should be recognized that various modifications, variations, and changes may be made as will be readily apparent to those of ordinary skill in the art and those modifications, variations and changes are intended to be within the scope of the present invention as defined by the following claims.

What is claimed is:

1. A foldable table tennis table comprising:

first singular continuous curvilinear member comprising a first horizontally disposed lower portion, said first lower portion having first and second ends, said first singular continuous curvilinear member also comprising upwardly extending first and second supporting portions, said upwardly extending first and second supporting portions each having first and second ends, said first supporting portion being formed at its first end to the first end of said lower portions, and the second supporting portion being formed at its first end to the second end of said first lower portion;

second singular continuous curvilinear member comprising a second horizontally disposed lower portion, said second lower portion having first and second ends, said second singular continuous curvilinear member also comprising upwardly extending first and second supporting portions, said upwardly extending first and second supporting portions each having first and second ends, said first supporting portion integrally joined being formed at its first end to the first end of said second lower portions, and the second supporting portion being formed at its first end to the second end of said second lower portion;

at least two connecting members, said connecting members connected between said first and second curvilinear members thereby forming said first and second curvilinear members and said connecting members into a rigid central support unit;

a first table portion and a second table portion each having an upper playing surface and a lower surface, a center edge, an outer edge and two opposing side edges, said lower surface of said first and second table portions being pivotally connected to the central support unit adjacent said center edges of said first and second table portions, so that said first and second table portions can be pivoted from an essentially horizontal playing position where the center edges are in close proximity to one another to an essentially vertical storage position with the outer edges of said first and second table portions are essentially parallel and slightly closer together than the inner edges of said first and second table portions.

2. A foldable table tennis table as claimed in claim 1, further comprising at least one first exterior leg member attached to the lower surface of the first table portion adjacent to the outer edge of the first table portion, and at least one second exterior leg member attached to the lower surface of the second table portion adjacent the outer edge of the second table portion, said first and second exterior leg members being extendable to contact a floor to support the first and second table portions in an essentially horizontal position.

3. A foldable table tennis table as claimed in claim 2, wherein said first exterior leg member and second exterior leg member are pivotally attached to the respective first and second table portions so that said exterior leg members can be folded against the lower surface or said first and second table portions respectively.

4. A foldable table tennis table as claimed in claim 2 or 3, wherein said first exterior leg member and second exterior leg member are respectively connected to said central support unit in a manner so that said first and second exterior legs automatically fold against said lower surface of said table portions as said table portions are raised from the essentially horizontal position to the essentially vertical position.

5. A foldable table tennis table as claimed in claim 2, wherein:

said first exterior leg member comprises a first and a second extension pivotally attached at a first end to the first table portion and a first curvilinear support member having first and second ends, said first and second ends being detachably connectable to a second end of said first and second extensions respectively;

said second exterior leg member comprises a third and a fourth extension pivotally attached at a first end to the second table portion and a second curvilinear support member having first and second ends, said first and second ends being detachably connectable to a second end of said third and fourth extensions respectively.

6. A foldable table tennis table as claimed in claim 1, wherein wheels are attached to said first and second lower portions of said first and second singular continuous curvilinear members to allow said rigid central support unit and attached first and second table portions to be easily rolled from place to place when said table portions are in the essentially vertical storage position.

7. A foldable table tennis table as claimed in claim 1, wherein said connecting members have apertures formed there through at each end thereof, and said first and second singular continuous curvilinear members have apertures formed there through that align with the apertures in said connecting members, and removable fasteners are inserted through said apertures to attached said connecting members to said curvilinear members.

8. A foldable table tennis table comprising:

first singular continuous curvilinear member comprising a first horizontally disposed lower portion, said first lower portion having first and second ends, said first singular continuous curvilinear member also comprising upwardly extending first and second supporting portions, said upwardly extending first and second supporting portions each having first and second ends, said first supporting portion being formed at its first end to the first end of said lower portions, and the second supporting portion being formed at its first end to the second end of said first lower portion;

second unitary curvilinear member formed to have a second lower portion, said second lower portion having first and second ends, said second curvilinear member also comprising upwardly extending first and second supporting portions, said upwardly extending first and second supporting portions each having first and second ends, said first supporting portion being formed at its first end to the first end of said second lower portions, and the second supporting portion being formed at its first end to the second end of said second lower portion;

first and second connecting members, said first connecting member connected between said first supporting portions of said first and second singular continuous curvilinear members and said second connecting member connected between said second supporting portions of said first and second singular continuous curvilinear members thereby forming said first and second singular continuous curvilinear members and said first and second connecting members into a rigid central support unit;

a first table portion having an upper playing surface and a lower surface, a center edge, an outer edge and two opposing side edges, said lower surface being pivotably connected to the second ends of said first supporting portions of said first curvilinear member adjacent said center edge of said first table portion;

a second table portion having an upper playing surface and a lower surface, a center edge, an outer edge and two side edges, said lower surface being pivotably connected to the second ends of said second supporting portions or said second curvilinear member adjacent said center edge of said second table portion;

whereby said first and second table portions can be pivoted from an essentially horizontal playing position where the center edges are in close proximity to one another to an essentially vertical storage position with the outer edges of said first and second table portions being essentially parallel and slightly closer together than the inner edges of said first and second table portions.

9. A foldable table tennis table as claimed in claim 8, where in said first and second connecting members are connected between said first and second supporting portions of said first and second singular continuous curvilinear members so that said first supporting portions of said first and second curvilinear members, and the second supporting portions of said first and second curvilinear members are tilted toward one another so that the second ends of said first supporting members are closer together than the first ends of said first supporting members and the second ends of said second supporting members are closer together than the first ends of said second supporting members.

10. A foldable table tennis table as claimed in claim 8, wherein said first and second connecting members have apertures formed there through at each end thereof, and said first and second supporting portions of said first and second singular continuous curvilinear members have apertures formed there through that align with the apertures in said first and second connecting members, and removable fasteners are inserted through said apertures to attached said connecting members to said supporting portions.

11. A foldable table tennis table as claimed in claim 7 or 10, wherein said fasteners are capable of being tightened and loosened by hand.

* * * * *